United States Patent [19]

Vinciguerra

[11] Patent Number: 4,924,915

[45] Date of Patent: May 15, 1990

[54] MODULATOR FOR CONTROLLING HIGH-SPEED ROTARY DOBBIES

[75] Inventor: Costantino Vinciguerra, Florence, Italy

[73] Assignee: Nuovopignone-Industrie Meccaniche E Fonderia S.p.A., Italy

[21] Appl. No.: 288,558

[22] Filed: Dec. 22, 1988

[30] Foreign Application Priority Data

Jan. 5, 1988 [IT] Italy ..... 19003 A/88

[51] Int. Cl.[5] ..... D03C 1/12

[52] U.S. Cl. ..... 139/76; 139/66 R

[58] Field of Search ..... 139/66 R, 66 A, 76

[56] References Cited

U.S. PATENT DOCUMENTS 4,326,563 4/1982 Brock et al. ..... 139/76

4,727,910 3/1988 Surkamp ..... 139/76

FOREIGN PATENT DOCUMENTS 0035954 9/1981 European Pat. Off. ..... 139/66 R

*Primary Examiner*—Andrew M. Falik

*Attorney, Agent, or Firm*—Morgan & Finnegan

[57] ABSTRACT

A modulator for controlling high-speed rotary dobbies of the type which control the dobby main shaft's motion by transmitting power from a drive shaft through pivotable rocker supports rotatably driven by the drive shaft and engaging conjugate cams so that the drive shaft's uniform rotary motion is converted into non-uniform motion of the dobby main shaft. This is caused by the conjugate cams, which cause the rocker supports to pivot. The rocker supports are mounted so as to accommodate this rocking. The two rocker supports are connected to the dobby main shaft by two connecting rods hinged by pins on one of the rocker supports and on an appendix of the main shaft respectively, these connecting rods being disposed antisymmetrically to each other in accordance with a particular geometry.

2 Claims, 2 Drawing Sheets

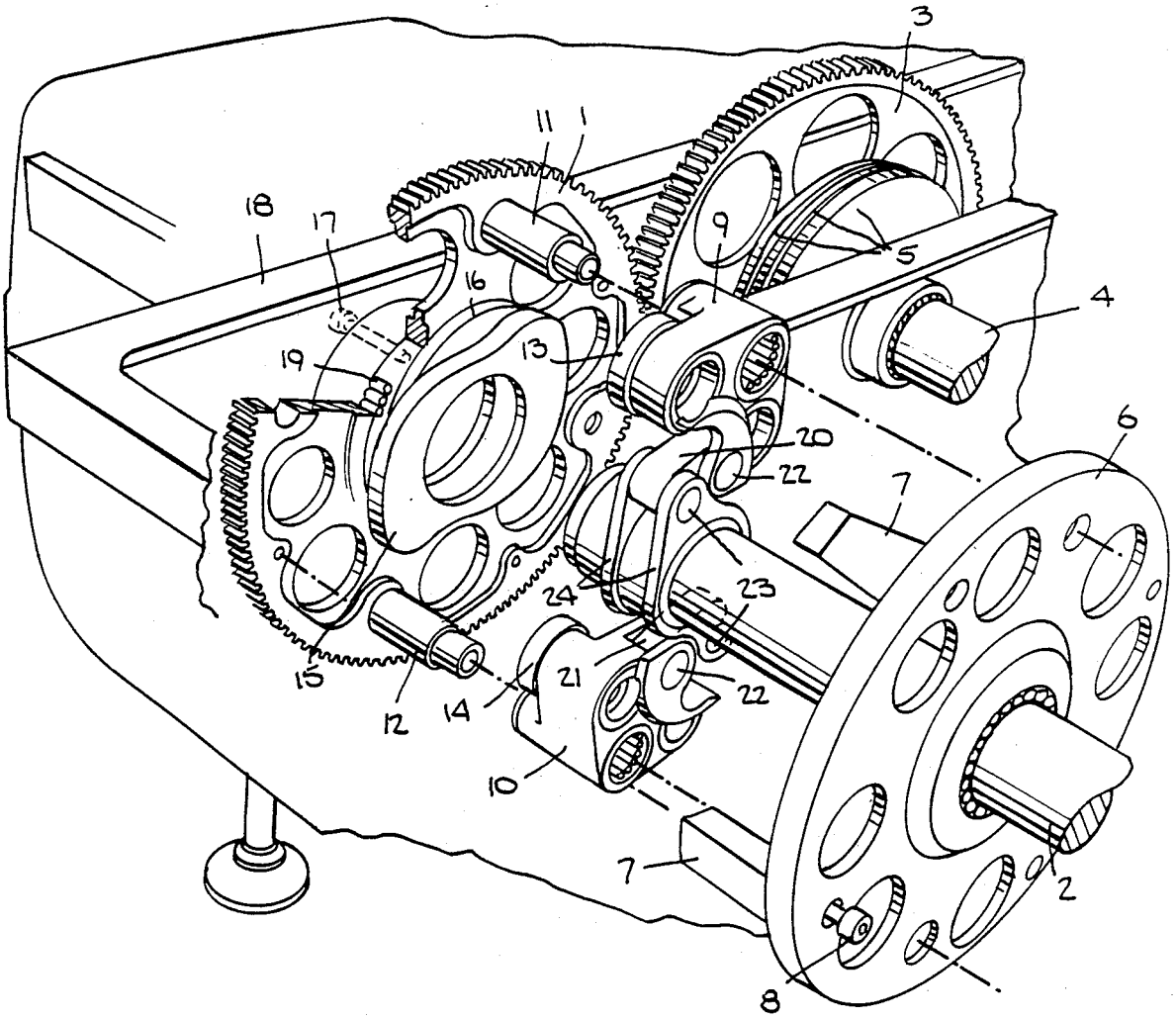
Fig. 1.
Fig. 4.
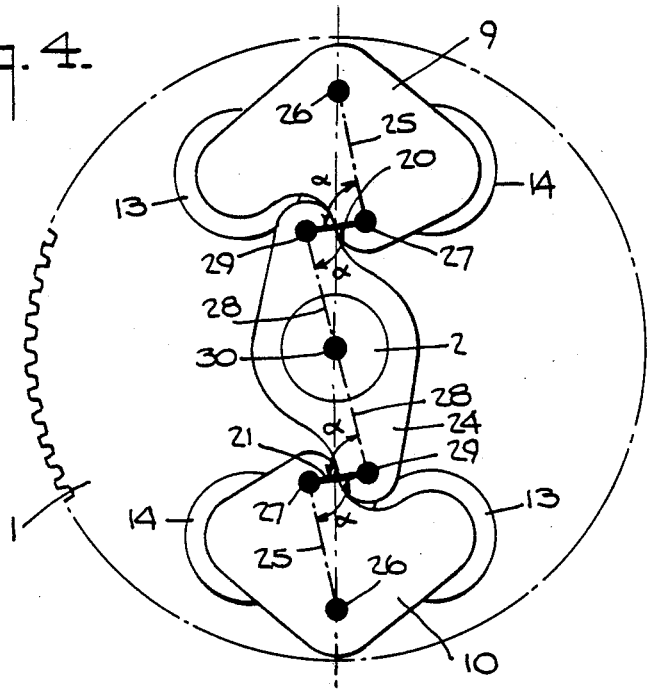

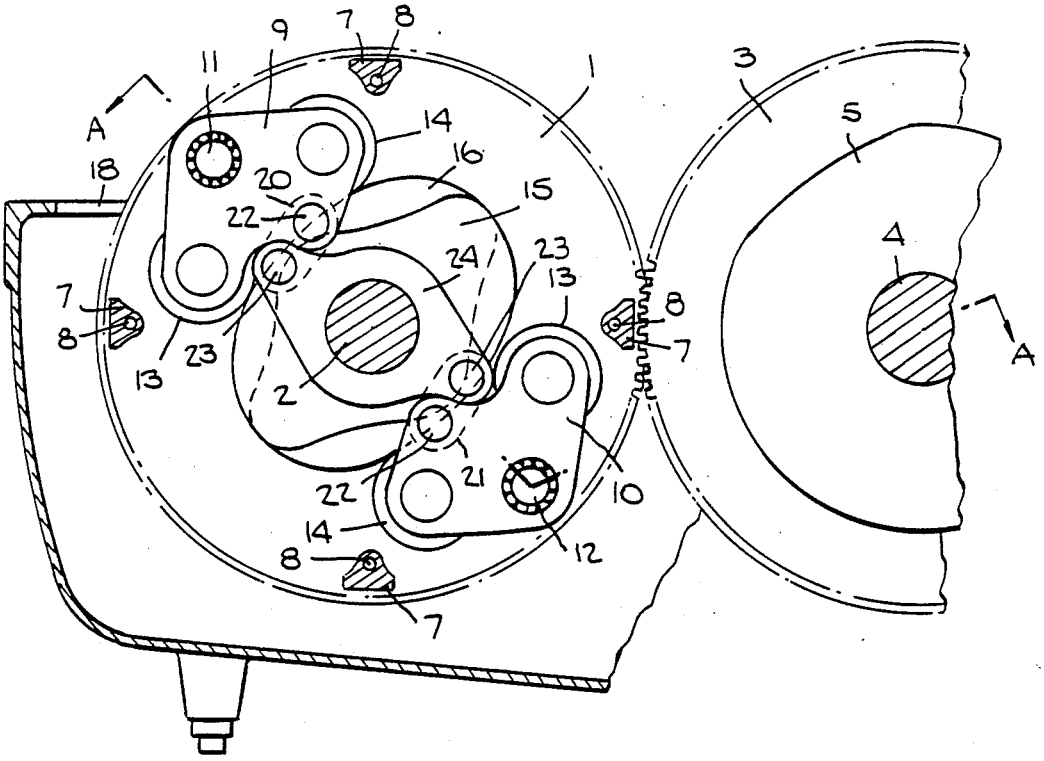
Fig. 2.
Fig. 3.
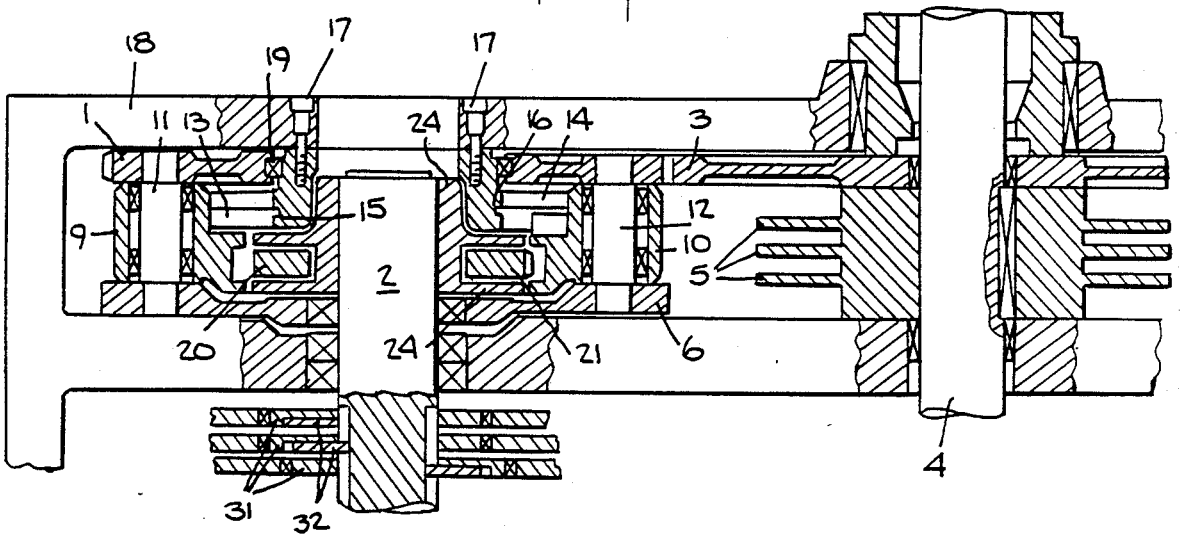

MODULATOR FOR CONTROLLING HIGH-SPEED ROTARY DOBBIES

FIELD OF THE INVENTION

This invention relates to a modulator for controlling rotary dobbies which by minimizing clearances and consequently minimizing vibration and the accompanying acceleration in the transmission of motion from the rocker support to the main dobby shaft results in highly efficient and accurate operation even at the very high operating speeds required of modern rotary dobbies.

BACKGROUND OF THE INVENTION

In using rotary dobbies the movements of the loom heddle frames are obtained by linkages operated by the main rotary shaft of the dobby which for every half revolution must undergo a pause during which keys can be inserted, withdrawn, or left inserted or left withdrawn, in order for said main shaft to be secured to or released from, or kept secured to or kept released from, the thrust rods which each control the movement of one heddle frame of the loom in accordance with a predetermined program. The rotary dobby control modulator is precisely that member which generates said keying pauses by converting the continuous motion of the dobby drive shaft into a motion comprising two pauses per revolution of the dobby main shaft.

Various types of modulators for rotary dobby control are known from the state of the art.

In one of these known types, said two pauses are obtained by two superposed conjugate cams fixed to the dobby casing coaxial to the drive shaft and main dobby shaft, and each with a contour having an axis of asymmetry (ie., they are specularly antisymmetrical), the cams cooperating with at least one system consisting of two wheels acting in the two different planes of said conjugate cams and carried by a rocker support comprising a toothed sector which engages with a gear wheel rigid with the dobby main shaft, said rocker support being hinged on a disc rigid with the dobby drive shaft.

In this manner the particular form of the conjugate cams means that for each revolution of the dobby drive shaft, said drive shaft and the dobby main shaft can undergo a relative movement such that the main shaft rotates intermittently with two short pauses every revolution, whereas the drive shaft continues to rotate at uniform angular velocity.

Such a construction has however two drawbacks the first of which is due to the fact that during the relative rotation between the toothed sector and the main shaft gear wheel the various teeth undergo a multiplicity of mutual contacts and variations in such contacts due to the clearances and the irregularity between the toothing, thus causing inaccuracies and harmful vibration during the intermittent rotation of the main shaft, such vibration becoming amplified and affecting the movement of the cam portions of the dobby thrust rods, and finally affecting the movement of the heddle frames, to thus affect the correct operation of the loom and result in frequent breakages of the yarns supported by said frames. The other drawback is that said toothed sectors are supported cantilevered on the disc rigid with the dobby drive shaft so that the flexure caused by the considerable forces acting on the hinge pins of said toothed sectors results in incorrect modulator operation because the contour of the conjugate cams is not perfectly followed, and as the effect increases with rotational speed the result is a further limitation on the use of this type of modulator, which is unsuitable for high-speed looms. Said drawbacks are lessened in another type of known modulator in which two rollers cooperating in different planes with the conjugate cams are carried by a rocker support which is hinged between a disc and a counter-disc rigid with the dobby drive shaft and comprises a guide slot in which a slider slides, pivoted on an appendix jutting from the main shaft.

In this manner the multiplicity of contact of the teeth is replaced by the sliding contact of the slider and the rotation of the hinge pin of the slider itself, and in addition the arrangement of the rocker supports, which are no longer cantilevered but rock about a shaft fixed at its two ends to rigid supports, obviates said drawback deriving from flexure. In this respect, whereas the teeth have very small contact surfaces and are subjected to correspondingly large variable hertzian pressure during the various engagement stages with consequent variable deformation leading to system vibration, the slider has a large sliding contact surface with consequent small deformation and relatively small clearances, to thus represent an assembly of greater operating precision and causing lesser vibration in the movement of the loom heddle frames, leading to lesser yarn breakages and fewer loom stoppages, with a smaller time lost for repairs.

However even this type of modulator has limitations in the case of operation at high loom speeds exceeding 500 beat-ups per minute as required for modern dobbies, because of the inevitable clearances and the constructional inaccuracies present in it.

In this respect it is well known that the damaging vibration is generated because of the clearances and increases exponentially with speed.

To increase the operating speed it is therefore necessary to reduce motion irregularities and vibration, and therefore to reduce the clearances present in the modulator to a minimum by improving the quality of its construction or machining. In said known modulator, a pin and slider are used to transmit motion from the rocker support to the main shaft. The loads transmitted are the same for the pin and slider, but this latter, because it contains the hinge pin in its interior, has to have fairly large transverse dimensions of at least two or three times the pin diameter, and therefore has at least two or three times the clearance of the pin because of the fact that the clearance required for mobile parts is proportional to their dimensions and their level of finishing. Again, as the flat slide surfaces of the slider must be able to easily slide along a guide and lubrication must be provided for, the clearances cannot be kept too narrow otherwise the oil cannot flow, and the slider becomes more inclined to seize because said flat surfaces easily tend to incline to the extend of the guide clearances, and to jam at the two opposing end corners, with the result that the clearances must be made even larger. To all this must then be added the intrinsic difficulties in the construction of flat surfaces such as those of the said slider and in particular of its guide, which can not be given the same level of finishing as that obtainable for a pin and its guide, for which precision grinding can be used for the pin and lapping can be used for the guide, resulting in considerable constructional precision.

OBJECT OF THE INVENTION

The object of the present invention is to obviate various drawbacks of existing dobby modulators by providing a modulator for controlling rotary dobbies which by minimizing moving parts clearances, with consequent minimization of the vibration and accleration arising in the transmission of motion between the rocker support and the dobby main shaft, results in highly efficient, precise and reliable operation even for dobbies operating at very high speed, while at the same time being of small axial dimensions.

SUMMARY OF THE INVENTION

The object of this invention is attained substantially by transmitting motion from the rocker support to the dobby main shaft only by way of pins, and specifically by connecting the two rocker supports to the dobby main shaft, which supports being situated on opposite sides of the axis of said main shaft, by two connecting rods disposed antisymmetrically to each other, i.e. parallel to each other in accordance with a particular geometry, each connecting rod being pivoted by two pins on one of said rocker supports and on an appendix of the dobby main shaft respectively.

In view of the foregoing discussion, the use of the two pins ensures, for equal loads and thus equal pin dimensions, that the clearances are at most one half of those required for systems of the known art, the two pins also representing the most precise and reliable solution from the construction and control aspects.

By exponentially reducing the accelerations induced in the loom heddle frames, these low clearance values allow substantial increases in the operating speeds of rotary dobbies, as fully proved by experimental tests. In fact, using a modulator in accordance with the present invention and all other conditions being equal (masses, frame lifts etc.), effective operating rates of more than 1000 beat-ups per minute have been obtained as against the 500–600 beat-ups per minute obtainable with current rotary dobbies, with the result that doubling of dobby speed has been possible.

To reduce the axial dimensions of the modulator, according to a further embodiment of the present invention, the drive shaft is disposed out of alignment with but parallel to the dobby main shaft so that the dobby auxiliary cams, i.e. the cams which control the insertion of said keys and the other functions of the dobby data reading system, instead of being coaxial to the main shaft as in the state of the art can now be arranged on said drive shaft in a position lateral to the modulator, so allowing the axial dimensions of the entire dobby to be reduced to a minimum. A further advantage deriving from the parallel misalignment between the drive shaft and dobby main shaft is that as all dobbies are required to operate at a rotational speed equal to one half that of the loom drive shaft, said halving of the rotational speed can now be obtained very advantageously by linking the two said dobby shafts together by two simple cylindrical gears one of which has one half the teeth of the other, this being an extremely economical solution compared with all known solutions of the state of the art which have to use connections comprising bevel gears which are notoriously costly and difficult to construct.

Furthermore, this offset but parallel arrangement of the drive shaft with respect to the main shaft frees that part of the wall of the dobby rigid casing which is opposite said main shaft, and on which it is now possible to fix the assembly comprising said two superposed fixed conjugate cams of the modulator, thus ensuring optimum modulator operating conditions in that as said cams are applied to the most rigid and accessible part of the dobby casing, they can now be easily fixed with very precise positioning of their axes and arranged in a state of maximum rigidity corresponding to minimum vibration.

Again, it should be noted that in known modulators the system has always been symmetrical about an axis passing through the fulcrums of said two rocker supports because this is known to allow the modulator to operate with equal acceleration both in swinging to the right and in swinging to the left about said axis of symmetry of said rocker supports, with consequent minimization of forces on the modulator members.

In contrast, in the present construction the use of two connecting rods disposed antisymmetrically about the axis of the dobby main shaft introduces an asymmetry which should result in unacceptably increased forces on said modulator members.

It has however been surprisingly found by theoretical kinematic analysis, which has been confirmed experimentally, that the force increase due to asymmetry is absolutely negligible, and less than 1%, if a particular geometry is used in which the segment joining the centre of rotation of a rocker support to the center on which the relative connecting rod is hinged to said rocker support is equal to that segment which joins the axis of said main shaft to the other center on which said connecting rod is hinged to said main shaft appendix, and further in which the length of said connecting rod is one half that of said equal segments, and finally in which the two angles which said connecting rod forms with said two equal segments are equal to 90° when said rocker supports are in the intermediate position of their oscillation.

It has also been found that small differences from said optimum geometrical conditions can be tolerated as they do not produce appreciable variations.

It is however clear that the aforesaid is valid for only small oscillations of the rocker supports, of the order of 20°, which are precisely the type found in rotary dobby modulators. Thus, although the modulator of the present invention leads to a slight worsening (less than 1%) in the theoretical acceleration compared with known methods because of its asymmetry, the advantages deriving from the notable reduction in its clearances are so considerable that, as stated, the overall effect is such as to allow a considerable increase in the rotary dobby operating speed.

The invention will be more apparent with reference to the accompanying drawings which illustrate a preferred embodiment thereof given by way of non-limiting example in that technical and constructional modifications can be made thereto but without leaving the scope of the present invention.

BRIEF DESCRIPTION OF THE DRAWINGS

In said drawings:

FIG. 1 is a partial exploded perspective view of a dobby modulator constructed according to the invention;

FIG. 2 is a longitudinal section through the modulator of FIG. 1;

FIG. 3 is a section on the line AA of FIG. 2;

FIG. 4 shows the particular geometry used in the modulator according to the invention.

DETAILED DESCRIPTION OF THE PREFERRED EMBODIMENTS

In the figures, the reference numeral 1 indicates a gear wheel coaxial with the dobby main shaft 2 and rotated with uniform motion by a second gear wheel 3 keyed on the dobby drive shaft 4, said shaft 4 being disposed out of alignment with but parallel to the main shaft 2 and supporting the auxiliary cam assembly 5. The gear wheel 1 is provided with double the number of teeth of the gear wheel 3 so that the dobby main shaft rotates at half the speed of the drive shaft 4, as is required.

The gear wheel 1 is bolted to an opposing disc 6 which is kept spaced apart therefrom by four feet 7 through which the four connection bolts 8 pass. Two rocker supports 9 and 10 are housed in diametrically opposite positions within the rigid structure formed by the gear wheel 1 and disc 6, and rock about two pins 11 and 12 rigidly supported by said gear wheel 1 and said disc 6.

The two said rocker supports cooperate by means of their wheels 13 and 14, disposed in two axially offset planes, with two overlying fixed conjugate cams 15 and 16 which are fixed directly onto the dobby casing 18 by bolts 17 and rotatably support said gear wheel 1 by means of the roller bearing 19.

The rocker supports 9 and 10 are connected to the main shaft 2 respectively by the two connecting rods 20 and 21 disposed antisymmetrically about the axis of said main shaft 2, each of them being hinged by pins 22 and 23 on a rocker suppport 9 or 10 and on a fork-shaped appendix 24 of the main shaft 2 respectively. Each of the two connecting rods 20 and 21 has a length (see specifically FIG. 4) equal to one half of the segment 25 joining the centre 26 of rotation of a rocker support 9 or 10 to the centre 27 on which the relative connecting rod 20 or 21 is hinged to said rocker support 9 or 10. Again, said segment 25 is equal to the segment 28 which joins the other centre 29, on which said connecting rod 20 or 21 is hinged to said appendix 24 of the main shaft 2, to the axis 30 of said main shaft 2, and in addition the angles which the connecting rods 20 and 21 form with said segments 25 and 28 are equal to 90° when the rocker supports 9 and 10 are in the intermediate position of their oscillation as shown in FIG. 4.

Finally, in FIG. 3 the reference numeral 31 schematically indicates some of the cam linkages for controlling the dobby heddle frames, not shown in the figure, and which can be made rigid with the dobby main shaft 2 by keys 32 insertable into splines in said shaft during the pauses determined by the modulator.

I claim:

1. A modulator for controlling a high-speed rotary dobby of the type having a drive shaft, a dobby main shaft bearing an appendix and having an axis, two superposed fixed conjugate cams, said cams being disposed coaxially to said dobby main shaft, two rocker supports each able to oscillate about a rocker support pivot point through a plurality of positions, including an intermediate position, each rocker support having wheels which cooperate with said cams, a disc coaxially disposed to said dobby main shaft, said rocker supports being hinged in diametrically opposite positions on said disc, said disc being rotated by said drive shaft, each said rocker support being connected to said dobby main shaft by the improvement comprising:

a connecting rod;

a rocker support pin;

an appendix pin;

said connecting rod being hingeably connected to said rocker arm by said rocker support pin and being hingeably connected to said appendix by said appendix pin;

said rocker support pivot point and said rocker support pin being separated by a first segment having a first length and said dobby main shaft axis and said appendix pin being separated by a second segment having a second length, said first and second lengths being approximately equal, said connecting rod having a length that is approximately one half of said first and second lengths, said connecting rod being dimensioned and disposed so that when said rocker support is in said intermediate position said connecting rod and said first and second segments form angles of 90°.

2. A modulator for controlling a high-speed rotary dobby as in claim 1, further comprising an outer dobby rigid casing having a wall opposite said main shaft and wherein said drive shaft is parallel to but offset from said dobby main shaft, said two superposed cams being fixed directly to said wall of said dobby rigid casing.

* * * * *